US008690012B2

(12) United States Patent
Stoeckli et al.

(10) Patent No.: US 8,690,012 B2
(45) Date of Patent: Apr. 8, 2014

(54) DISPENSING ASSEMBLY COMPRISING A CARTRIDGE WITH BAG

(75) Inventors: Rochus Stoeckli, Buochs (CH); Andy Greter, Steinhausen (CH); Wilhelm A. Keller, Merlischachen (CH)

(73) Assignee: Medmix Systems AG, Rotkreuz (CH)

( * ) Notice: Subject to any disclaimer, the term of this patent is extended or adjusted under 35 U.S.C. 154(b) by 306 days.

(21) Appl. No.: 13/059,621

(22) PCT Filed: Jul. 7, 2009

(86) PCT No.: PCT/CH2009/000240

§ 371 (c)(1),
(2), (4) Date: Feb. 17, 2011

(87) PCT Pub. No.: WO2010/020060

PCT Pub. Date: Feb. 25, 2010

(65) Prior Publication Data

US 2011/0138741 A1 Jun. 16, 2011

(30) Foreign Application Priority Data

Aug. 19, 2008 (CH) ..... 1314/08

(51) Int. Cl.
*B67D 1/00* (2006.01)

(52) U.S. Cl.
USPC ..... 222/82; 222/80; 222/83; 222/94; 222/145.5

(58) Field of Classification Search
USPC ..... 222/81–82, 85–86, 83, 83.5, 88–91, 94, 222/80, 87, 137, 145.5, 145.6
See application file for complete search history.

(56) References Cited

U.S. PATENT DOCUMENTS

| | | | | |
|---|---|---|---|---|
| 3,193,146 | A | 7/1965 | Isgriggs et al. | |
| 3,964,641 | A | 6/1976 | Langensiepen et al. | |
| 4,538,920 | A * | 9/1985 | Drake | 366/181.5 |
| 4,681,243 | A | 7/1987 | Takasugi | |
| 4,735,509 | A * | 4/1988 | Rausch | 366/333 |
| 4,801,008 | A | 1/1989 | Rich | |

(Continued)

FOREIGN PATENT DOCUMENTS

| | | |
|---|---|---|
| DE | 3826887 A1 | 2/1990 |
| DE | 19618693 | 11/1997 |

(Continued)

OTHER PUBLICATIONS

PCT International Search Report and Written Opinion on international application No. PCT/CH2009/000240 dated Sep. 11, 2009; 9 pages.

*Primary Examiner* — Paul R Durand
*Assistant Examiner* — Jeremy W Carroll
(74) *Attorney, Agent, or Firm* — Foley & Lardner LLP

(57) ABSTRACT

The dispensing assembly comprises a double cartridge having two storage containers with bags placed therein, a mixer that is connectable to the cartridge, and an opening means acting upon the bag. The opening means is arranged on the mixer housing and rotatable with respect to the cartridge and in one exemplary embodiment has a cutting member with two knife-edges that are arranged essentially parallelly to and spaced apart from the longitudinal axis and provided with cutting edges. Thanks to the rotatable knife-edges, such a cutting member allows a clean and predetermined opening of the bags and a dispensing operation with minimum pressure losses and lost volumes.

12 Claims, 3 Drawing Sheets

(56) References Cited

U.S. PATENT DOCUMENTS

| | | | | |
|---|---|---|---|---|
| 5,033,650 | A * | 7/1991 | Colin et al. | 222/137 |
| 5,897,028 | A * | 4/1999 | Sauer | 222/82 |
| 6,564,970 | B1 | 5/2003 | Walch et al. | |
| 6,644,509 | B1 | 11/2003 | Bublewitz et al. | |
| 6,702,161 | B2 * | 3/2004 | Adams et al. | 222/521 |
| 6,874,657 | B2 * | 4/2005 | Metzner et al. | 222/82 |
| 2003/0051610 | A1 * | 3/2003 | Dux et al. | 99/495 |

FOREIGN PATENT DOCUMENTS

| | | | |
|---|---|---|---|
| EP | 154345 | | 9/1985 |
| EP | 1112779 | | 7/2001 |
| FR | 2761346 | | 10/1998 |
| NL | 9200318 | | 9/1993 |
| WO | WO 00/61457 | | 10/2000 |
| WO | WO 00/76676 | A1 | 12/2000 |
| WO | WO 01/44074 | | 6/2001 |

* cited by examiner

DISPENSING ASSEMBLY COMPRISING A CARTRIDGE WITH BAG

CROSS-REFERENCE TO RELATED PATENT APPLICATIONS

This application is a US national phase application of PCT application no. PCT/CH2009/000240 filed Jul. 7, 2009 which claims priority from Switzerland Application 01314/08, filed Aug. 19, 2008. All of the aforesaid applications are incorporated herein by reference in their entirety as if fully set forth herein.

TECHNICAL FIELD

The present invention relates to a dispensing assembly comprising a cartridge having at least one storage container with a bag placed therein, a dispensing device that is connectable to the cartridge, and opening means acting upon the bag.

BACKGROUND OF THE INVENTION

A dispensing assembly of this kind is e.g. known from DE 19618693, EP 1 112 779, or WO 0061457. These and other dispensing assemblies with bags have in common that the opening, resp. cutting member essentially acts frontal on the bags(s) within the cartridge, in the longitudinal direction of the cartridge, and is rigidly arranged.

Particularly in multiple cartridges, this opening procedure has the following disadvantages:

A restriction of the bag opening since the opening mechanism and the cartridge outlet diameter are interdependent.

Large volumes of lost material since the path up to the point where the two components are merged can only be realized by long channels leading to the mixer inlet.

In the case of highly viscous materials, the pressure drop is high because the two components cannot be conducted from the bags into the mixer on the shortest and direct path.

Frontal piercing along the longitudinal axis of the bags entails the risk that the bag is torn in an undefined manner instead of being opened by a geometrically defined opening procedure.

Moreover, in the devices of the prior art, parts of the bag may involuntarily be torn off and possibly applied along with the mass in an uncontrolled manner.

SUMMARY OF THE INVENTION

On the background of this prior art, it is an object of the present invention to provide a dispensing assembly of the aforementioned kind that allows a controlled opening of the bag(s) and a clean dispensing while the pressure loss and the volume of lost outflowing material are to be kept as low as possible. This is accomplished by the dispensing assembly wherein the opening means comprises a cutting member that is rotatable with respect to the cartridge and has one or a plurality of knife-edge(s) that are arranged in distance from the longitudinal axis of the cartridge. Further advantages and embodiments of the invention are described in the dependent claims.

BRIEF DESCRIPTION OF THE DRAWINGS

The invention will be explained in more detail hereinafter with reference to drawings of an exemplary embodiment.

DETAILED DESCRIPTION OF THE INVENTION

Figure 1:
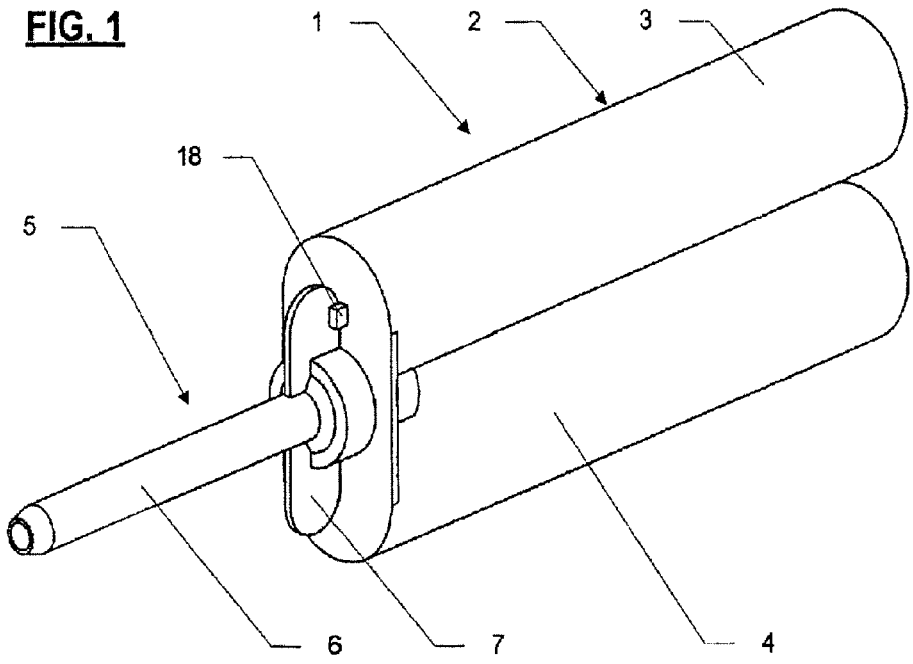
FIG. 1 shows a perspective view of an exemplary embodiment of a A dispensing assembly according to the invention.

FIG. 1 shows a dispensing assembly 1 according to the invention with a double cartridge 2 including the two storage containers 3 and 4, and a dispensing device, in this case a mixer 5 that is connected to cartridge 2. Mixer housing 6 has two actuating wings 7.

Figure 2:
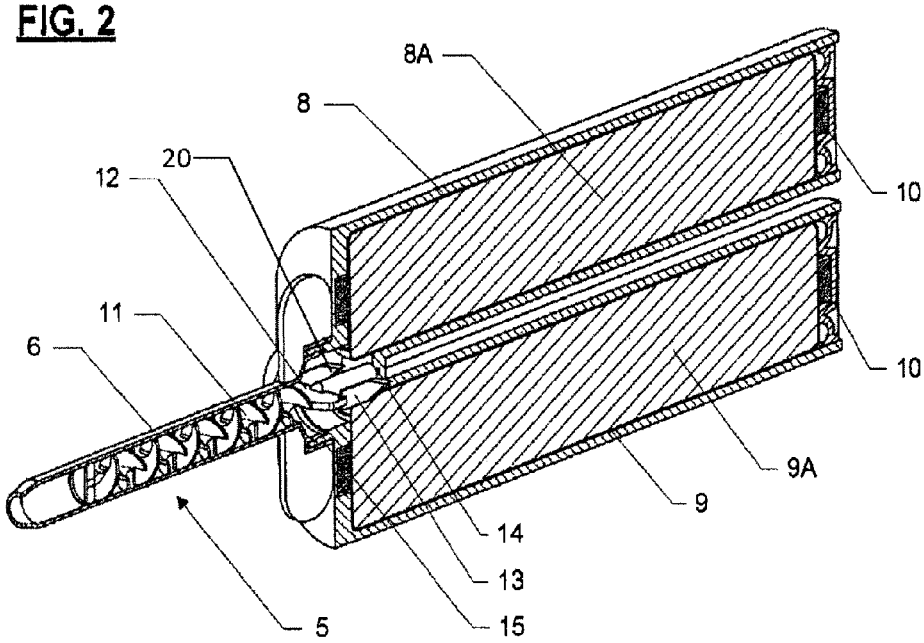
FIG. 2 shows a longitudinal section of the assembly of FIG. 1 in the unopened condition, with a double cartridge and a cutting member with two knife-edges.

In FIG. 2 it is seen that in storage containers 3 and 4 of the cartridge, respective bags 8 and 9 are placed in which different materials 8*a* and 9*a* may be contained. To the rear, at the end opposite the outlet, the cartridge is sealed by respective pistons 10.

Mixer housing 6 holds mixing elements 11. Connected to mixing elements 11 is a driving member 12 having a guide pin 12A and a cutting member 13 arranged thereon which in the present case comprises two knife-edges 20 that are arranged and orientated essentially parallelly to and in a distance from driving member 12, respectively to the longitudinal axis of the mixer, and are provided with sharp edges 14.

The cutting member may consist of the same material as the mixing elements or of metal or another material. Instead of two knife-edges, a single knife-edge arranged essentially parallelly to the longitudinal axis may be used which in this case is rotatable 360°. In an embodiment variant, the knife-edges may be arranged and orientated at an angle to the longitudinal axis.

It is further apparent in the drawings that the mixer is fitted to the cartridge rotatably and sealingly, the cartridge having an outlet flange 15 with a circumferential groove 16 in which a bead 17 at the inlet side end of the mixer housing engages. The actuating wings 7 arranged on the mixer housing facilitate the rotation of the housing and of the cutting member connected thereto. Instead of the circumferential groove, the cartridge may be provided with a corresponding fastening means for the rotatable attachment of the mixer.

In the case of a cutting member having two knife-edges, it is advantageous to provide a stop in order to prevent that it can be rotated more than 180° as the blade should no longer be active once the bag has been cut open. In FIG. 1, a stop cam 18 on the cartridge is illustrated, but a large number of other stop means are possible. Alternatively, instead of the stop means, a non-releasable snap arrangement may be provided so that the cutting member cannot be turned back after having opened the bag.

Figure 3:
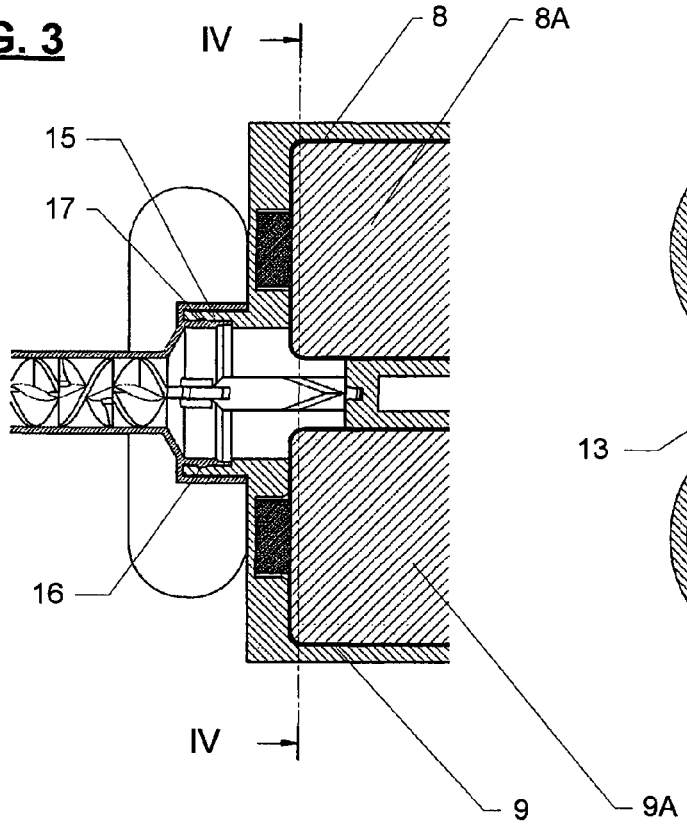
FIG. 3 shows an enlarged detail of FIG. 2.
Figure 4:
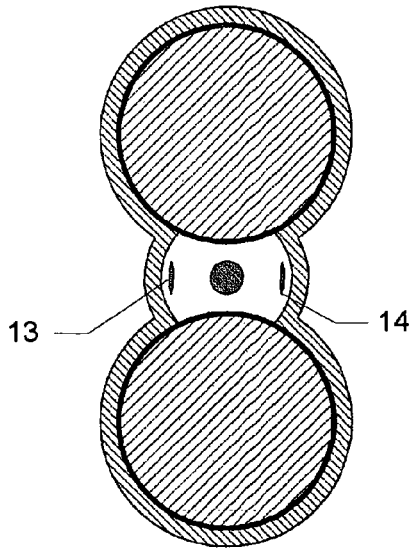
FIG. 4 shows a section according to line IV-IV in FIG. 3, FIGS. 5 and 6 are analogous to FIGS. 3 and 4, with a partly rotated cutting member during the operation of cutting the bag open.
Figure 5:
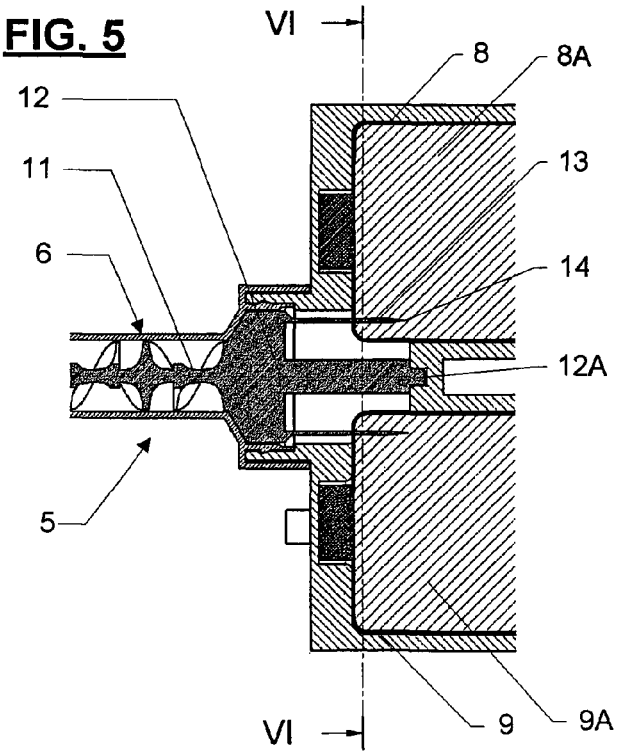
Figure 6:
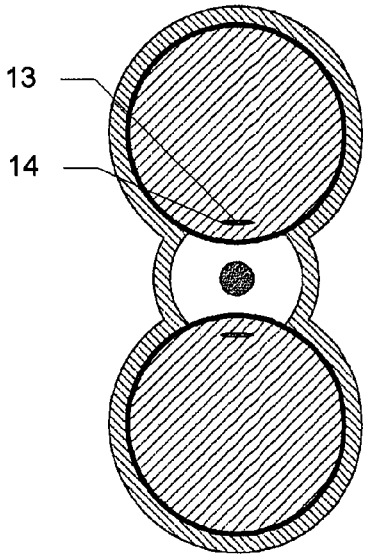

In FIGS. 3 and 4, respectively 5 and 6, the starting position and the middle of the cutting operation are illustrated.

Figure 7:
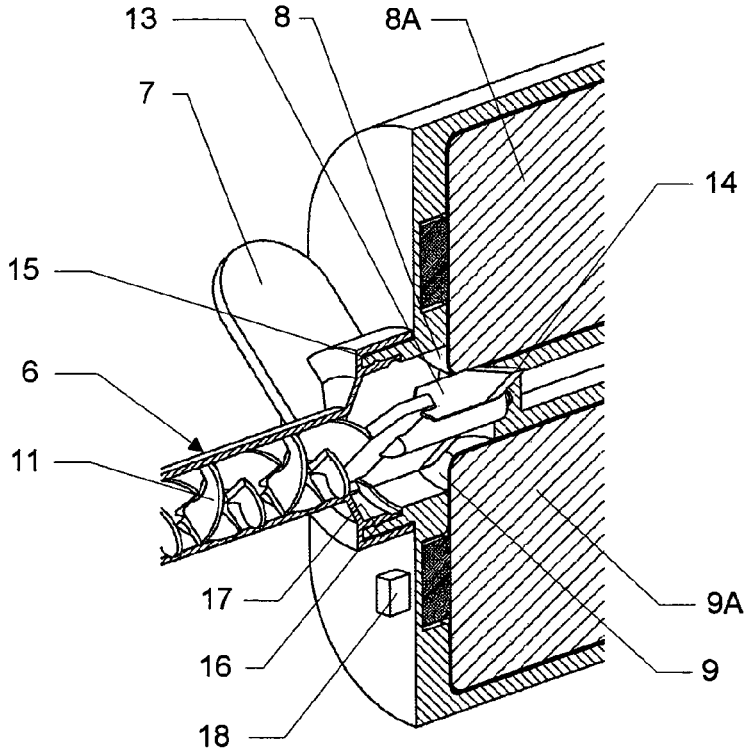
FIG. 7 shows an enlarged detail of FIG. 2 prior to cutting the bags open.
Figure 8:
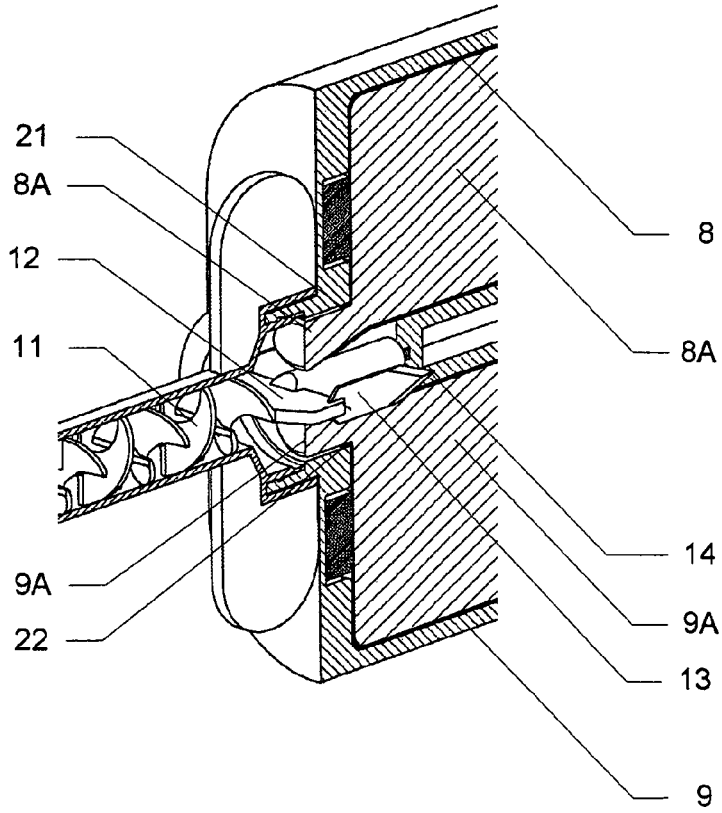
FIG. 8 shows an enlarged detail of FIG. 2 after the bags have been cut open and at the beginning of the dispensing operation.

In FIGS. 7 and 8, the dispensing assembly is illustrated before and after cutting the bags open and at the beginning of the dispensing. The double cartridge may be placed in a dispensing appliance that is known in the art per se and whose double plungers act upon pistons 10. As appears in FIG. 8, the outflowing substances have pressed the two tabs 21 and 22 of bags 8 and 9 that are formed in the cutting operation toward the center, i.e. against guide pin 12A, thereby creating a clearly defined opening of the bags so that the substances may reach the mixer inlets and thus the mixing elements. In this arrangement, the path to the mixing elements is direct and thus the pressure loss and the lost volume are minimum. Due to the fact that the cut-open wall of the bag is pushed away to the center, there is no risk that frayed parts of the bag might be torn off.

In difference to the above disclosed exemplary embodiment, it is also possible to arrange a cutting member having three knife-edges between a triple cartridge, respective bags being placed in three storage containers. By a rotation of the mixer housing with the knife-edges by 120°, the three bags can be opened simultaneously. It is possible in this arrangement also to use a single knife-edge with a rotation of 360°, whereby the opening operation is carried out essentially simultaneously.

Instead of three or more storage containers in a corresponding cartridge, a single storage container with a single bag may be provided that is opened by a correspondingly shaped but similarly acting cutting member.

Moreover, the cutting member need not be connected to the mixing elements; both in a mixer and in a dispensing device of another kind, the cutting member may be connected to a ring that is arranged on the dispensing device and rotatable with respect to the cartridge. This is especially the case if a bayonet coupling between the cartridge and the dispensing device is used.

Instead of a mixer, the dispensing device connected to the cartridge may consist of a spray device with a spray head, an adapter, or a dispensing tube, the rotatable cutting member being arranged in the coupling section thereof. Alternatively, the rotatable cutting member with the twisting device may be designed as an additional functional unit.

The invention claimed is:

1. A dispensing assembly comprising a cartridge having two or more storage containers with a bag placed in each of the two or more storage containers, a dispensing device that is connectable to the cartridge, and an opening means acting upon the bags, wherein the opening means comprises a single cutting member that is rotatable with respect to the cartridge about the longitudinal axis of the cartridge, in order to open each of the bags contained in the two or more storage containers of the cartridge, and has one or a plurality of knife-edge(s) that are arranged in distance from the longitudinal axis of the cartridge wherein the dispensing device is a mixer comprising a mixer housing and mixing elements contained inside of the mixer housing, and the cutting member is connected to the mixing elements that are snapped in place in the mixer housing.

2. The dispensing assembly according to claim 1, wherein the knife-edge(s) of the cutting member is (are) essentially parallel to the longitudinal axis of the cartridge.

3. The dispensing assembly according to claim 1, wherein the cutting member has a plurality of knife-edges being arranged at an angle to the longitudinal axis of the cartridge.

4. The dispensing assembly according to claim 1, wherein the dispensing device comprises a housing, and wherein the cutting member is connected to the housing of the dispensing device and actuatable by a rotation of the housing.

5. The dispensing assembly according to claim 1, wherein the cartridge is a double cartridge and the dispensing device is a mixer, the cutting member having one or two knife-edges.

6. The dispensing assembly according to claim 1, wherein the cartridge is a triple cartridge and the dispensing device is a mixer, the cutting member having one or a plurality of knife-edges.

7. The dispensing assembly according to claim 1, wherein the dispensing device is arranged on the cartridge in a rotatable and axially secured manner.

8. The dispensing assembly according to claim 7, wherein the dispensing device has an inlet end and the cartridge has an outlet flange, and wherein the inlet end of the dispensing device has a bead that is snapped in place in a circumferential groove in the outlet flange of the cartridge.

9. The dispensing assembly according to claim 1, wherein the mixer housing has actuating wings.

10. The dispensing assembly according to claim 1, wherein the cartridge has stop means or retaining means in order to limit or fix the angle of rotation of the cutting member.

11. The dispensing assembly according to claim 1, wherein the cutting member has one knife edge capable of rotating 360° to open each of the bags contained in the two or more storage containers of the cartridge.

12. The dispensing assembly according to claim 1, wherein the cutting member has two knife-edges capable of rotating 180° to open each of the bags contained in the two or more storage containers of the cartridge.

* * * * *